US012343842B2

(12) United States Patent
Lin

(10) Patent No.: US 12,343,842 B2
(45) Date of Patent: Jul. 1, 2025

(54) GROUND LEVELING GRINDER

(71) Applicant: Xinsen Lin, Dongying (CN)

(72) Inventor: Xinsen Lin, Dongying (CN)

( * ) Notice: Subject to any disclaimer, the term of this patent is extended or adjusted under 35 U.S.C. 154(b) by 314 days.

(21) Appl. No.: 18/009,112

(22) PCT Filed: May 12, 2021

(86) PCT No.: PCT/CN2021/093213
§ 371 (c)(1),
(2) Date: Dec. 8, 2022

(87) PCT Pub. No.: WO2021/254032
PCT Pub. Date: Dec. 23, 2021

(65) Prior Publication Data

US 2023/0278162 A1 Sep. 7, 2023

(30) Foreign Application Priority Data

Jun. 15, 2020 (CN) ..... 202010546711.4

(51) Int. Cl.
*B24B 47/12* (2006.01)
*B24B 7/18* (2006.01)
*B24B 41/047* (2006.01)

(52) U.S. Cl.
CPC ..... *B24B 47/12* (2013.01); *B24B 7/186* (2013.01); *B24B 41/047* (2013.01)

(58) Field of Classification Search
CPC ..... B24B 47/12; B24B 47/10; B24B 41/047; B24B 41/0475; B24B 7/186; A47L 11/4069; A47L 11/4038
(Continued)

(56) References Cited

U.S. PATENT DOCUMENTS 6,540,596 B1 * 4/2003 Van Der Veen ..... B24B 7/186 451/350
2005/0164616 A1 7/2005 Thysell
(Continued)

FOREIGN PATENT DOCUMENTS

CN 202861989 U * 4/2013
CN 205237800 U 5/2016
(Continued)

OTHER PUBLICATIONS

CN-202861989-U English Translation (Year: 2013).*
KR-20090119519-A English Translation (Year: 2019).*
International search report of PCT/CN2021/093213.

*Primary Examiner* — Makena S Markman

(57) ABSTRACT

A ground leveling grinder comprises a main motor connecting disk (1), wherein a driving shaft (4) is vertically provided in the middle section of the circular channel (41) of the main motor connecting disk (1), a hollow shaft sleeve (9) which is rotatable with respect to the driving shaft is sleeved outside the driving shaft (4), a worm gear (3) is installed at the periphery of the middle section of the hollow shaft sleeve (9), a worm (2) is installed in the worm box (10), the worm gear (3) is meshed with the worm (2), a driving gear (13) is installed at the lower end of the driving shaft (4), the driving gear (13) is meshed with an intermediate gear (14), the intermediate gear (14) is meshed with a driven gear (15), and a grinding disk (12) is installed on the output shaft of the driven gear (15).

5 Claims, 4 Drawing Sheets

(58) Field of Classification Search
USPC ..... 451/350, 353
See application file for complete search history.

(56) References Cited

U.S. PATENT DOCUMENTS

| | | | | |
|---|---|---|---|---|
| 2010/0267316 | A1 | 10/2010 | Silver et al. | |
| 2022/0339756 | A1* | 10/2022 | Ottosson | B24B 47/12 |

FOREIGN PATENT DOCUMENTS

| | | | | |
|---|---|---|---|---|
| CN | 105952861 | A | | 9/2016 |
| CN | 107073672 | A | | 8/2017 |
| CN | 111546160 | A | | 8/2020 |
| DE | 2929479 | A1 | | 2/1981 |
| JP | 2001162525 | A | | 6/2001 |
| KR | 20090119519 | A | * | 11/2019 |
| NL | 1014015 | C2 | | 7/2001 |

* cited by examiner

GROUND LEVELING GRINDER

TECHNICAL FIELD

The present disclosure relates to a ground grinding construction device, in particular to a ground leveling grinder.

BACKGROUND

A ground leveling machine is a multi-functional machine that integrates different processes such as carrying out rapid sealing curing agent floor, floor hardening, epoxy floor treatment, stone renovation, concrete leveling, grinding, polishing, etc. which is light, flexible and high in working efficiency.

In the prior art, most grinders with a plurality of groups of grinding disks use belts to drive a plurality of grinding disks, such as Chinese patent CN107073672B. In the case of belt transmission, when grinding the ground with high resistance, the belt is easy to slip so as to result in uneven ground grinding, which leads to low grinding efficiency and even secondary grinding. Moreover, the circumferential revolution of three grinding disks is a vertical motor, which directly drives the edge of the grinding disks to rotate. Because the vertical motor is installed on the edge, the problems of unbalanced gravity and deviating grinding of the grinding disks may arise.

In addition, in the prior art, an independent driving device is used to drive a plurality of grinding disks to auto-rotate and revolve. When grinding the ground, the torque of the independent driving device is small, so that the independent driving device is not suitable for the environment with large ground grinding resistance.

SUMMARY

Technical Problem

The purpose of the present disclosure is to provide a ground leveling grinder aiming at the defects existing in the prior art, which solves the problems in the prior art that the grinding belt slips in the case of a plurality of grinding disks, the stress of the circumferential revolution of three grinding disks is unbalanced, the torque is small, and the power is insufficient.

Solution to the Problem

Technical Solution

The technical solution is as follows: a ground leveling grinder, comprising a main motor connecting disk, wherein a circular channel is provided in the vertical center of the disk surface of the main motor connecting disk, a driving shaft is vertically provided in the middle section of the circular channel, the upper part of the driving shaft is rotatably connected with the main motor connecting disk with respect to each other, a hollow shaft sleeve which is rotatable with respect to the driving shaft is sleeved outside the driving shaft, a worm gear is fixedly installed at the periphery of the middle section of the hollow shaft sleeve, the periphery of the hollow shaft sleeves at the upper part and the lower part of the worm gear is rotatably connected with the main motor connecting disk with respect to each other, the lower surface of the hollow shaft sleeve and the upper surface of the gear box are fixedly installed, the lower part of the main motor connecting disk is provided with a worm box, a worm is horizontally installed in the worm box, the worm gear is meshed with the worm, a second motor is installed on the worm box, the second motor drives the worm to rotate, the upper end of the driving shaft is provided with a blind hole, a first motor is installed on the upper surface of the main motor connecting disk, an output shaft of the first motor is installed in the blind hole, a driving gear is coaxially fixed at the lower end of the driving shaft, the periphery of the driving shafts at the upper part and the lower part of the driving gear is rotatably connected with the gear box with respect to each other, the driving gear is meshed with an intermediate gear, the middle shaft of the intermediate gear is rotatably connected with the gear box with respect to each other, the intermediate gear is meshed with a driven gear, the middle shaft of the driven gear is rotatably connected with the gear box with respect to each other, and a grinding disk is installed on the output shaft of the driven gear. The rotation of the gear box is driven independently and driven by a worm gear and a worm, which increases the revolution torque of three grinding disks without affecting the auto-rotation of a single grinding disk and can realize the rotation of the gear box in any direction.

Further, the upper part of the driving shaft is installed with a third bearing, the third bearing is rotatably connected with the main motor connecting disk with respect to each other, the periphery of the hollow shaft sleeve at the upper part of the worm gear is installed with a first bearing, the periphery of the hollow shaft sleeve at the lower part of the worm gear is installed with a second bearing, the first bearing and the second bearing are rotatably connected with the main motor connecting disk with respect to each other, respectively, the upper part and the lower part of the driving gear are installed with driving gear bearings, respectively, the driving gear bearing is rotatably connected with the gear box with respect to each other; the upper part and the lower part of the intermediate gear are installed with intermediate gear bearings, respectively, the intermediate gear bearing is rotatably connected with the gear box with respect to each other; the upper part and the lower part of the driven gear are installed with driven gear bearings, respectively, and the driven gear bearing is rotatably connected with the gear box with respect to each other. The rotating connecting parts are connected by bearings to reduce the rotating resistance.

Further, the first bearing, the second bearing, the third bearing, the driving gear bearing, the intermediate gear bearing and the driven gear bearing are tapered roller bearings. The gear is clamped by the tapered roller bearing, which can bear both the radial load and the axial load.

Further preferably, a counterweight installing device is provided at the radially symmetrical position of the worm box with the main motor connecting disk as the center, and a counterweight block opposite to the installing position of the second motor is provided on the counterweight installing device. The counterweight installing device is used, the worm box is used to install the driving device, and the counterweight installing device is used to install the counterweight block, so that the gravity of the worm box is the same as that of the counterweight installing device, and finally the overall rotating counterweight of the gear box is balanced.

Further preferably, there are three driven gears, which are circumferentially and uniformly installed in the gear box. Three driven gears are used. Each of the driven gears is installed with a grinding disk. The angle between the grinding disks is uniformly distributed in the gear box at 120 degrees, so that the ground can be uniformly ground.

Compared with the prior art, the present disclosure has the following advantages: the design is reasonable, the action is reliable, the revolution and the auto-rotation are driven by different motors, respectively, and the torque is large; the grinding disk is driven by a gear, which will not slip when the grinding resistance is high; the second motor is provided with a counterweight at the radially symmetrical position, so that the overall counterweight of the gear box is balanced without being biased to one side for grinding, and the gear box can rotate in any direction.

BENEFICIAL EFFECT OF THE PRESENT DISCLOSURE

DETAILED DESCRIPTION OF THE EMBODIMENTS

The technical solution in the embodiments of the present disclosure will be clearly and completely described below with reference to the drawings in the embodiments of the present disclosure. Obviously, the described embodiments are only part of the embodiments of the present disclosure, rather than all of the embodiments.

The terms "first" and "second" are only used for the purpose of description, and cannot be understood as indicating or implying relative importance or implicitly indicating the number of the indicated technical features. Therefore, the features defined as "first" and "second" may include one or more of these features explicitly or implicitly.

Figure 1:
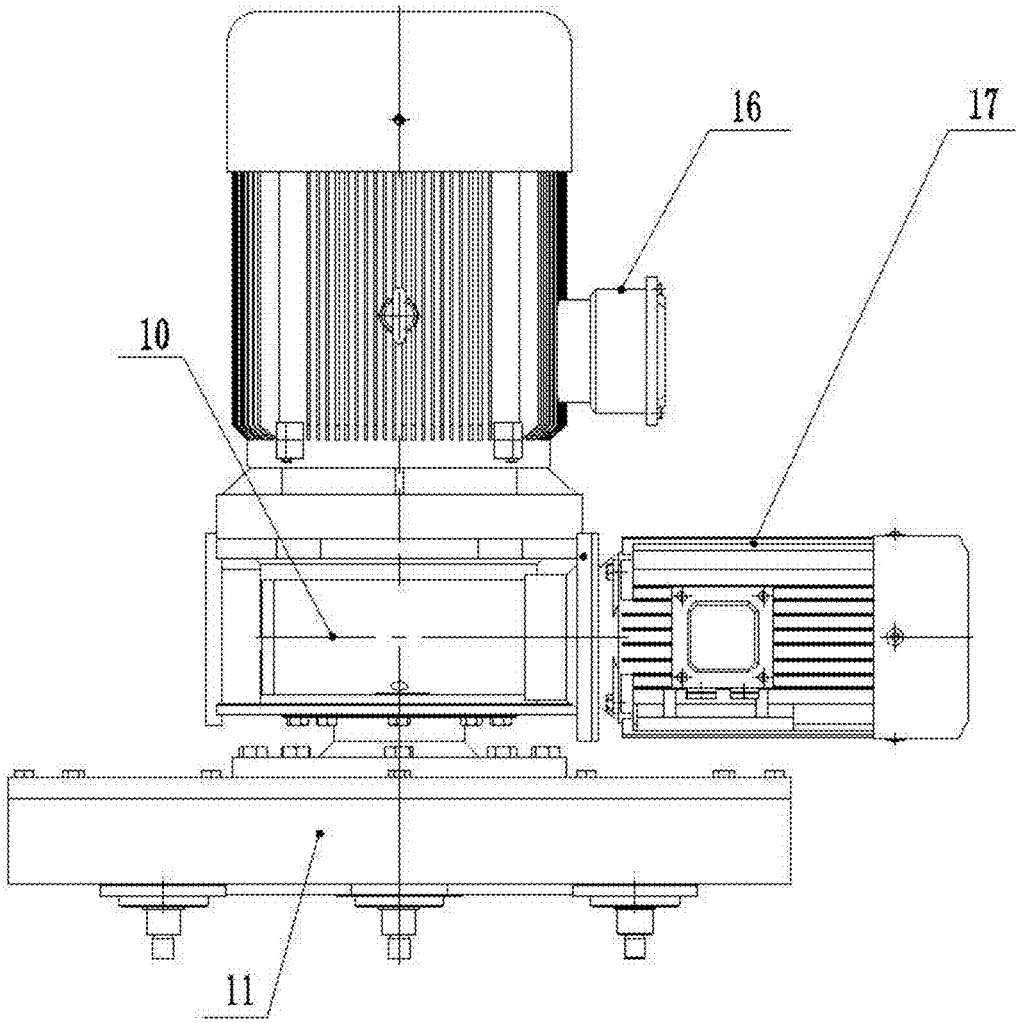
FIG. 1 is an external structure view of the present disclosure.
Figure 2:
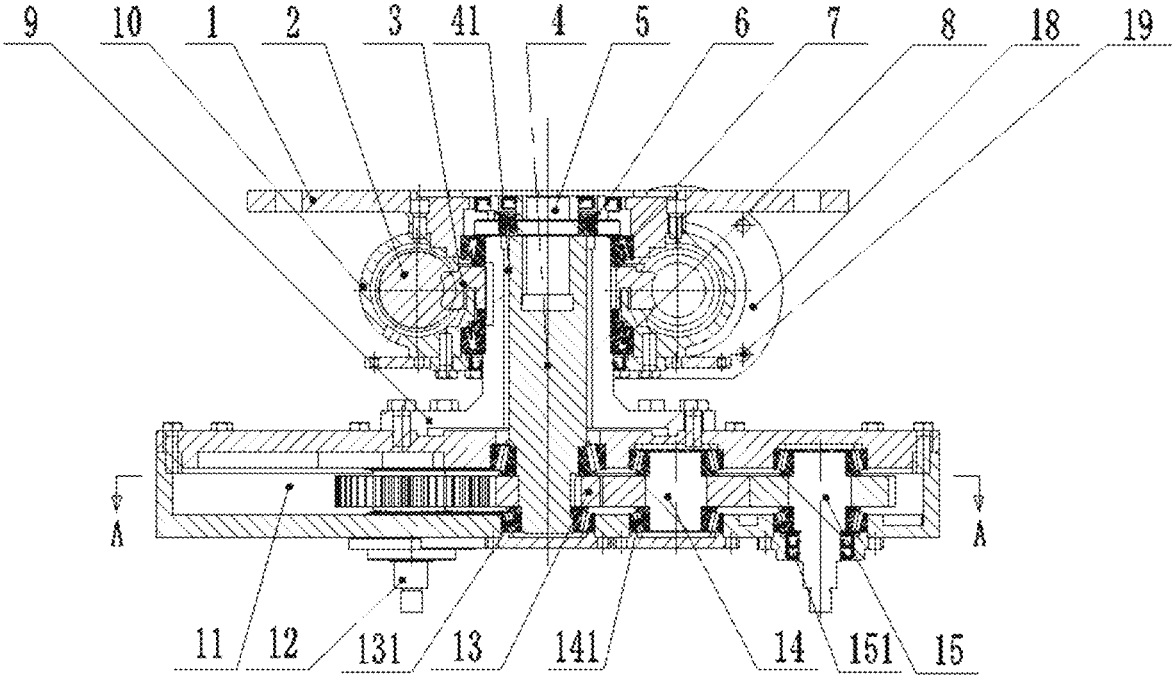
FIG. 2 is a cross-sectional view of the present disclosure without a motor.
Figure 3:
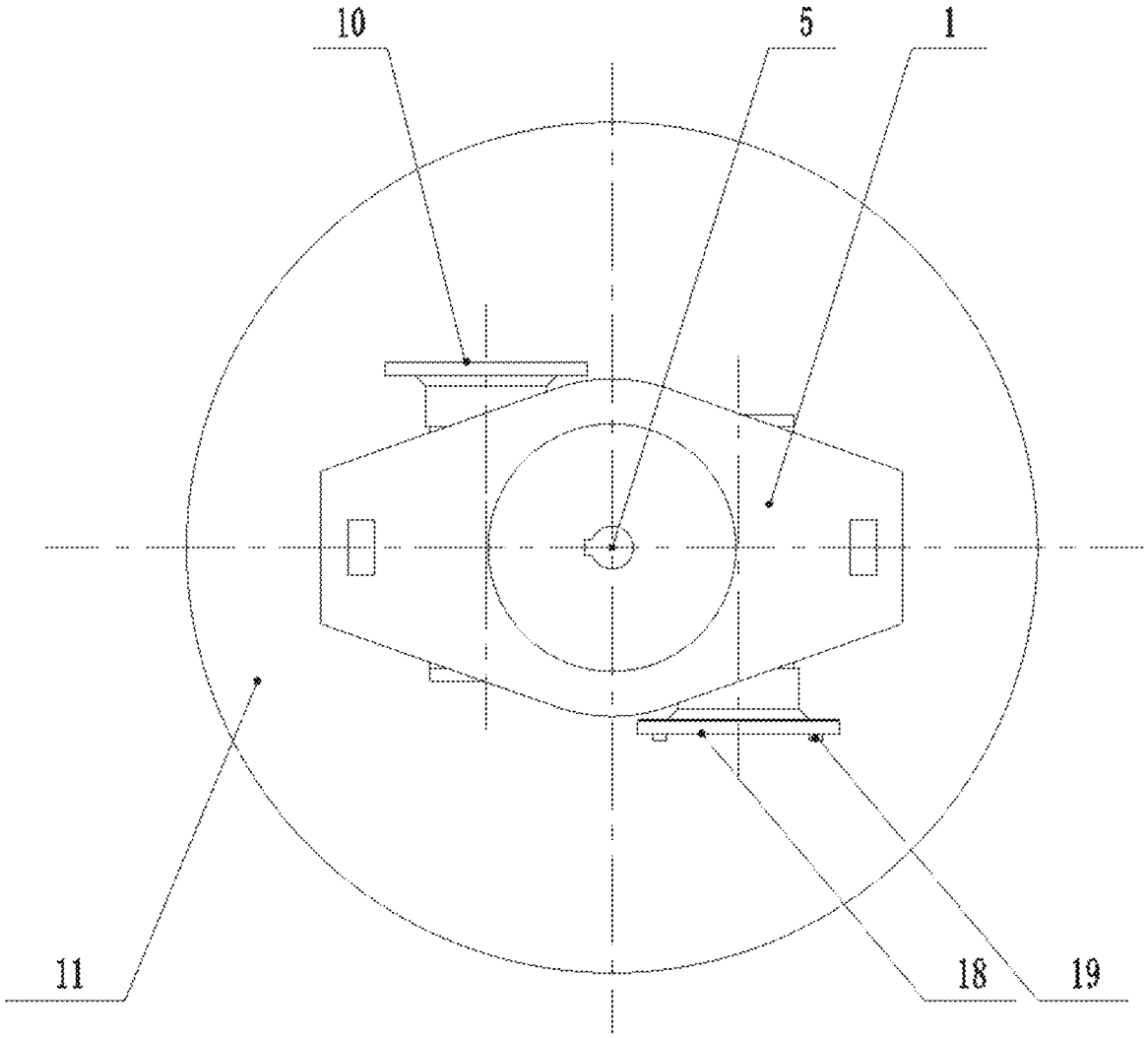
FIG. 3 is a top view of the present disclosure without a motor.
Figure 4:
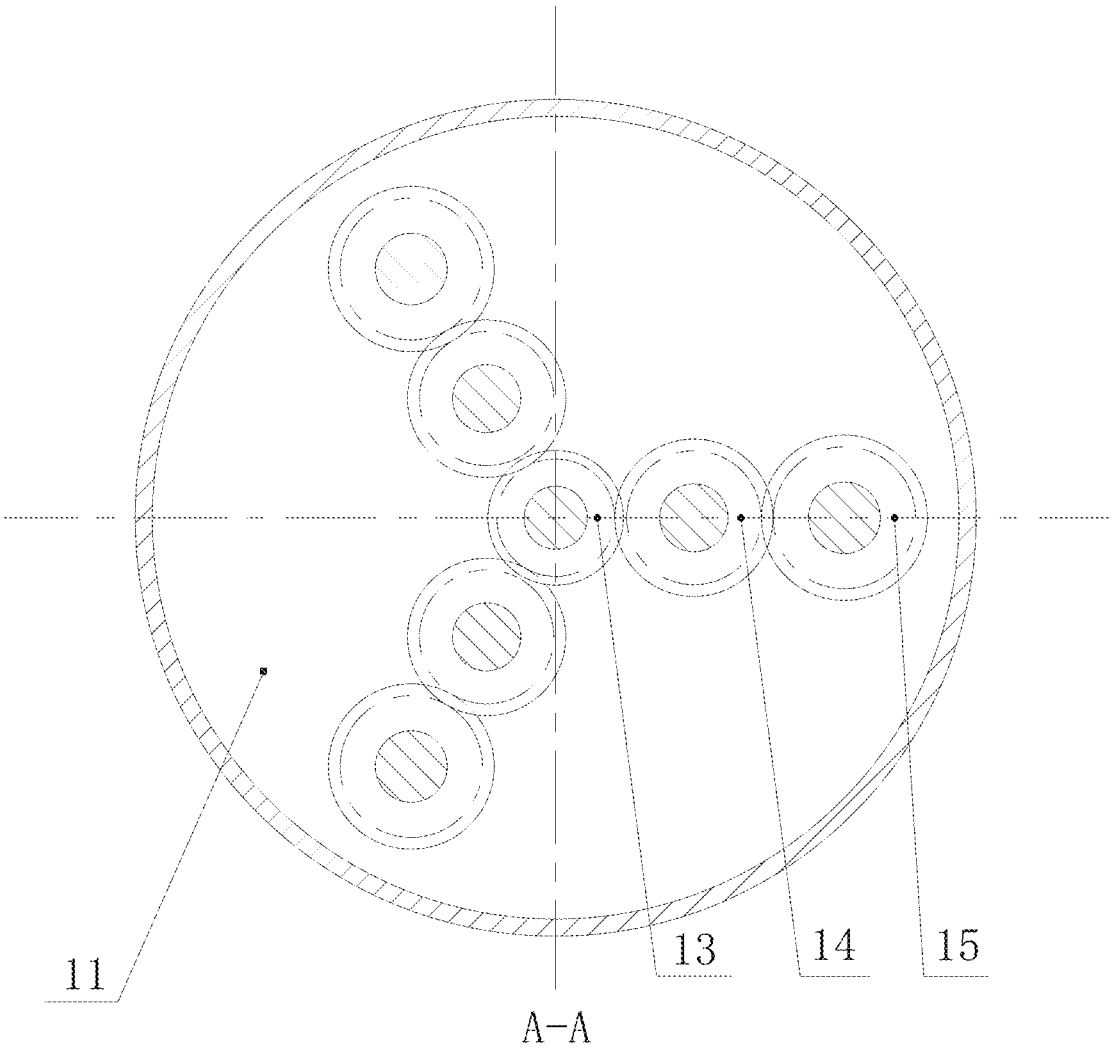
FIG. 4 is a cross-sectional view taken along line A-A of FIG. 2 of the present disclosure.

Referring to FIGS. 1-4, a ground leveling grinder is provided, comprising a main motor connecting disk 1. A circular channel 41 is provided in the vertical center of the disk surface of the main motor connecting disk 1. A driving shaft 4 is vertically provided in the middle section of the circular channel 41 The upper part of the driving shaft 4 is rotatably connected with the main motor connecting disk 1 with respect to each other. A hollow shaft sleeve 9 which is rotatable with respect to the driving shaft is sleeved outside the driving shaft 4. A worm gear 3 is fixedly installed at the periphery of the middle section of the hollow shaft sleeve 9. The periphery of the hollow shaft sleeves 9 located at the upper part and the lower part of the worm gear 3 is rotatably connected with the main motor connecting disk 1 with respect to each other. The lower surface of the hollow shaft sleeve 9 and the upper surface of the gear box 11 are fixedly installed. The lower part of the main motor connecting disk 1 is provided with a worm box 10. A worm 2 is horizontally installed in the worm box 10. The worm gear 3 is meshed with the worm 2. A second motor 17 is installed on the worm box 10. The second motor 17 drives the worm 2 to rotate. The upper end of the driving shaft 4 is provided with a blind hole 5. A first motor 16 is installed on the upper surface of the main motor connecting disk 1. An output shaft of the first motor 16 is installed in the blind hole 5. A driving gear 13 is coaxially fixed at the lower end of the driving shaft 4. The periphery of the driving shafts 4 located at the upper part and the lower part of the driving gear 13 is rotatably connected with the gear box 11 with respect to each other. The driving gear 13 is meshed with an intermediate gear 14. The middle shaft of the intermediate gear 14 is rotatably connected with the gear box 11 with respect to each other. The intermediate gear 14 is meshed with a driven gear 15. The middle shaft of the driven gear 15 is rotatably connected with the gear box 11 with respect to each other. A grinding disk 12 is installed on the output shaft of the driven gear 15.

The upper part of the driving shaft 4 is installed with a third bearing 6. The third bearing 6 is rotatably connected with the main motor connecting disk 1 with respect to each other. The periphery of the hollow shaft sleeve 9 at the upper part of the worm gear 3 is installed with a first bearing 7. The periphery of the hollow shaft sleeve 9 at the lower part of the worm gear 3 is installed with a second bearing 8. The first bearing 7 and the second bearing 8 are rotatably connected with the main motor connecting disk 1 with respect to each other, respectively. The upper part and the lower part of the driving gear 13 are installed with driving gear bearings 131, respectively. The driving gear bearing 131 is rotatably connected with the gear box 11 with respect to each other. The upper part and the lower part of the intermediate gear 14 are installed with intermediate gear bearings 141, respectively. The intermediate gear bearing 141 is rotatably connected with the gear box 11 with respect to each other. The upper part and the lower part of the driven gear 15 are installed with driven gear bearings 151, respectively. The driven gear bearing 151 is rotatably connected with the gear box 11 with respect to each other.

The first bearing 7, the second bearing 8, the third bearing 6, the driving gear bearing 131, the intermediate gear bearing 141 and the driven gear bearing 151 are tapered roller bearings.

A counterweight installing device 18 is provided at the radially symmetrical position of the worm box 10 with the main motor connecting disk 1 as the center, and a counterweight block 19 opposite to the installing position of the second motor 17 is provided on the counterweight installing device 18.

There are three driven gears 15, which are circumferentially and uniformly installed in the gear box 11. The angle between the grinding disks 12 is uniformly distributed in the gear box 11 at 120 degrees. The gear box 11 can realize the forward rotation and reverse rotation by adjusting the rotating direction of the second motor 17, so that the ground can be uniformly ground.

Working Principle:

As to auto-rotation of each grinding disk: the first motor 16 drives the driving gear 13 in the gear box 11 to rotate through the driving shaft 4. The driving gear 13 drives the intermediate gear 14 to rotate. The intermediate gear 14 drives the driven gear 15 to rotate. Finally, the grinding disk 12 installed on the shaft of the driven gear 15 rotates.

As to revolution of three grinding disks: the hollow shaft sleeve 9 provided around the driving shaft 4 does not interfere with the rotation of the driving shaft 4. The second motor 17 drives the worm 2 in the worm box 10 to rotate. The worm 2 drives the worm gear 3 to rotate. The worm gear 3 is fixedly installed at the periphery of the hollow shaft sleeve 9. The hollow shaft sleeve 9 rotates. The hollow shaft sleeve 9 is fixedly connected with the gear box 11, finally driving the gear box 11 to rotate.

The external structure of the counterweight installing device 18 can be the same as that of the worm box 10. The counterweight installing device 18 is connected with the counterweight block 19. The counterweight block 19 can be used cooperatively according to the weight of the second motor 17 to balance the counterweight around the whole gear box 11.

The above are only the preferred specific embodiments of the present disclosure, but the scope of protection of the present disclosure is not limited thereto. Any equivalent substitution or change made by those skilled in the art within the technical scope disclosed by the present disclosure according to the technical solution of the present disclosure and the inventive concept thereof should be covered in the scope of protection of the present disclosure.

What is claimed is:

1. A ground leveling grinder, comprising a main motor connecting disk (1), wherein a circular channel (41) is provided in a vertical center of the disk surface of the main motor connecting disk (1), a driving shaft (4) is vertically provided in the middle section of the circular channel (41), an upper part of the driving shaft (4) is rotatably connected with the main motor connecting disk (1), a hollow shaft sleeve (9) which is rotatable with respect to the driving shaft is sleeved outside the driving shaft (4), a worm gear (3) is fixedly installed at a periphery of the middle section of the hollow shaft sleeve (9), the periphery of the hollow shaft sleeve (9) located at an upper part and a lower part of the worm gear (3) is rotatably connected with the main motor connecting disk (1), a lower surface of the hollow shaft sleeve (9) and an upper surface of a gear box (11) are fixedly installed, a lower part of the main motor connecting disk (1) is provided with a worm box (10), a worm (2) is horizontally installed in the worm box (10), the worm gear (3) is meshed with the worm (2), a second motor (17) is installed on the worm box (10), the second motor (17) drives the worm (2) to rotate, an upper end of the driving shaft (4) is provided with a blind hole (5), a first motor (16) is installed on an upper surface of the main motor connecting disk (1), an output shaft of the first motor (16) is installed in the blind hole (5), a driving gear (13) is coaxially fixed at a lower end of the driving shaft (4), a periphery of the driving shaft (4) located at an upper part and lower part of the driving gear (13) is rotatably connected with the gear box (11), the driving gear (13) is meshed with an intermediate gear (14), a middle shaft of the intermediate gear (14) is rotatably connected with the gear box (11), the intermediate gear (14) is meshed with a driven gear (15), a middle shaft of the driven gear (15) is rotatably connected with the gear box (11), and a grinding disk (12) is installed on an output shaft of the driven gear (15).

2. The ground leveling grinder according to claim 1, wherein the upper part of the driving shaft (4) is installed with a third bearing (6), the third bearing (6) is rotatably connected with the main motor connecting disk (1); the periphery of the hollow shaft sleeve (9) at the upper part of the worm gear (3) is installed with a first bearing (7), the periphery of the hollow shaft sleeve (9) at the lower part of the worm gear (3) is installed with a second bearing (8), the first bearing (7) and the second bearing (8) are rotatably connected with the main motor connecting disk (1); the upper part and the lower part of the driving gear (13) are installed with driving gear bearings (131), respectively, the driving gear bearing (131) is rotatably connected with the gear box (11); the upper part and the lower part of the intermediate gear (14) are installed with intermediate gear bearings (141), respectively, the intermediate gear bearing (141) is rotatably connected with the gear box (11); the upper part and the lower part of the driven gear (15) are installed with driven gear bearings (151), respectively, and the driven gear bearing (151) is rotatably connected with the gear box (11).

3. The ground leveling grinder according to claim 2, wherein the first bearing (7), the second bearing (8), the third bearing (6), the driving gear bearing (131), the intermediate gear bearing (141) and the driven gear bearing (151) are tapered roller bearings.

4. The ground leveling grinder according to claim 1, wherein a counterweight installing device (18) is provided at the radially symmetrical position of the worm box (10) with the main motor connecting disk (1) as the center, and a counterweight block (19) opposite to an installing position of the second motor (17) is provided on the counterweight installing device (18).

5. The ground leveling grinder according to claim 1, wherein there are three driven gears (15), which are circumferentially and uniformly installed in the gear box (11).

* * * * *